US006966448B1

(12) United States Patent
Burkett

(10) Patent No.: US 6,966,448 B1
(45) Date of Patent: Nov. 22, 2005

(54) TRAILER-MOUNTED CRANE APPARATUS

(76) Inventor: Darryl Scott Burkett, Riverwalls Ltd., P.O. Box 562, Barrington, IL (US) 60011

( * ) Notice: Subject to any disclaimer, the term of this patent is extended or adjusted under 35 U.S.C. 154(b) by 106 days.

(21) Appl. No.: 09/644,923

(22) Filed: Aug. 23, 2000

(51) Int. Cl.[7] ..... B66C 23/90
(52) U.S. Cl. ..... 212/180; 212/231; 212/238
(58) Field of Search ..... 212/180, 300, 212/231, 238

(56) References Cited

U.S. PATENT DOCUMENTS

| | | | | |
|---|---|---|---|---|
| 2,126,597 A | * | 8/1938 | Zeilman | |
| 2,387,087 A | * | 10/1945 | Nelson | 212/180 |
| 2,643,515 A | * | 6/1953 | Harsch | 60/423 |
| 2,701,649 A | * | 2/1955 | Hallstrom | 414/23 |
| 2,932,244 A | * | 4/1960 | Moyer | 100/39 |
| 3,329,184 A | * | 7/1967 | Longert | 144/3 |
| 3,352,369 A | * | 11/1967 | Bodine, Jr. | 175/56 |
| 3,368,696 A | * | 2/1968 | Johnston et al. | |
| 3,414,027 A | * | 12/1968 | Larva et al. | |
| 3,547,284 A | * | 12/1970 | Dunbar | 214/77 |
| 3,554,317 A | * | 1/1971 | Birbanescu et al. | 182/14 |
| 3,682,253 A | * | 8/1972 | McIntosh et al. | 173/189 |
| 3,800,966 A | * | 4/1974 | Newton | 214/77 |
| 3,828,864 A | * | 8/1974 | Haverkamp et al. | 173/149 |
| 3,860,175 A | * | 1/1975 | Westerlund et al. | 239/165 |
| 3,944,081 A | * | 3/1976 | Wellman | 212/46 B |
| 3,987,563 A | * | 10/1976 | Baur | 37/345 |
| 4,183,712 A | | 1/1980 | Lindberg | |
| 4,322,178 A | * | 3/1982 | Lee | 404/83 |
| 4,609,018 A | * | 9/1986 | Barker | 144/4.6 |
| 4,625,811 A | * | 12/1986 | Tuenkers | 173/49 |
| 4,925,358 A | * | 5/1990 | Cook | 414/685 |
| 4,969,789 A | * | 11/1990 | Searle | 414/10 |
| 5,018,923 A | * | 5/1991 | Melan et al. | 414/10 |
| RE33,840 E | * | 3/1992 | Peterson et al. | 144/208 J |
| 5,480,041 A | | 1/1996 | Turner | |
| 5,544,979 A | | 8/1996 | White | |
| 5,733,068 A | * | 3/1998 | Reinert | 405/232 |
| 5,794,716 A | | 8/1998 | White | |
| 5,823,272 A | * | 10/1998 | van Halteren | 173/49 |
| 5,934,409 A | * | 8/1999 | Citron et al. | 182/18 |

FOREIGN PATENT DOCUMENTS

| | | | |
|---|---|---|---|
| DE | 2415230 | * 10/1975 | |
| SE | 308381 | * 2/1969 | 212/301 |

* cited by examiner

*Primary Examiner*—Thomas J. Brahan
(74) *Attorney, Agent, or Firm*—The Law Office of Randall T. Erickson, P.C.

(57) ABSTRACT

A trailer-mounted crane apparatus includes a trailer supported from a ground surface on at least two wheels. A hydraulically operated crane arm is mounted to the trailer and is extendable outwardly. A crane hydraulic power unit is mounted to the trailer and supplies pressurized hydraulic fluid to the crane arm. A vibrational sheet piling driver can be supported by the crane arm. A vibrational hydraulic power unit for supplying power to the driver is mounted on the trailer. A control panel for the crane hydraulic power unit and the vibrational driver hydraulic power unit, and an associated operator's seat, are also mounted on the trailer. The crane apparatus includes wide tires for reducing the surface pressure under the apparatus. This allows the apparatus to be transported across and used on delicate surfaces such as golf course greens and other groomed surfaces.

12 Claims, 6 Drawing Sheets

TRAILER-MOUNTED CRANE APPARATUS

TECHNICAL FIELD OF THE INVENTION

The present invention relates to cranes, and particularly relates to a trailer-mounted crane which is useful in supporting a vibratory sheet piling driver.

BACKGROUND OF THE INVENTION

In landscaping architecture, there sometimes exists a need, particularly around water, for the protection of banks and other land formations from erosion, or a need to maintain a bank at an angle steeper than its natural soil angle of repose. This is sometimes accomplished by the use of sheet piling.

In a typical sheet piling installation, individual, elongated steel sheets having channeled edges are driven into the soil, one after another, in interlocking fashion, to create a sheet piling wall. In this regard, a vibratory driver is sometimes used to drive the sheets into the ground. A typical vibratory driver includes a clamping jaw and a vibratory motor, both hydraulically driven by a separate, engine-driven hydraulic power unit. The driver is suspended from a line or cable from a lifting apparatus, such as from the bucket of an excavator on a back hoe, and positioned for the jaw to clamp the sheet piling sheet at its upper edge. Vibration from the driver causes the sheet to be driven into the ground.

One difficulty in driving sheet piling is related to a type of terrain that may be located adjacent to the area that is to receive the sheet piling. Where sheet piling is to be driven adjacent to a pond, for example, the local area can be soft, or uneven. On a golf course, for example, the area adjacent to the sheet piling, or access ways to that area, may be delicate and can be damaged by heavy equipment.

The present inventor has recognized that it would be desirable that an apparatus used for supporting a vibratory driver for sheet piling is able to operate on surfaces which can include soft, delicate or uneven soil. The present inventor has recognized that it would be desirable that such an apparatus is operable in use on a golf course to install sheet piling around ponds and other areas susceptible to having soft, delicate, and/or uneven ground surfaces. The present inventor has recognized that it would be desirable if a single operator could operate both the supporting apparatus and the vibratory driver from a single operator station.

SUMMARY OF THE INVENTION

The invention provides a mobile crane in the form of a trailer-mounted crane apparatus which includes a trailer supported on wheels from the ground. A crane is mounted onto the trailer and includes a crane arm that is extendable outwardly of the trailer. A crane hydraulic power unit for operating the crane arm is also mounted on the trailer. The crane hydraulic power unit is controlled from an operator station carried by the trailer. The operator station includes a control panel and an operator's seat facing the control panel.

The trailer includes a trailer hitch connection at a front end thereof adapted for towing the trailer by a vehicle. The trailer rear wheels can mount wide tires to reduce the contact pressure of the tires on the ground. Adjacent each of the rear wheels, a hydraulic outrigger can be utilized for stabilizing the vehicle during use. The trailer can also include two front outriggers, also useful for stabilizing the trailer.

In an exemplary form of the invention, a vibratory sheet piling driver is suspended from the crane arm. The vibratory sheet piling driver can be extended outwardly from the trailer by the crane arm and operated to grasp, position and sink a sheet into the ground. The vibratory driver vibrates to drive the piling sheet into the ground. A vibratory driver hydraulic power unit can be mounted onto the platform and controlled from the control panel.

Using the inventive apparatus, a sheet piling wall can be installed adjacent to soft, loose or uneven ground without difficulty. A trailer-mounted crane apparatus can be configured of a sufficiently light weight to be usable upon delicate ground surfaces, such as are present on a golf course, without damaging the surfaces, such as might occur using a heavier truck-mounted crane or a back hoe. The preferred embodiment crane apparatus of the present invention is compact and usable in close quarters compared to the aforementioned larger truck-mounted cranes or back hoes. The preferred embodiment crane apparatus of the present invention includes wide tires for reducing the surface pressure under the trailer. This allows the trailer to be transported across, and staged on, delicate surfaces such as golf course greens.

The preferred embodiment crane apparatus of the present invention comprises a trailer-mounted crane apparatus having a component layout on the trailer that maximizes lifting capacity and reach. The layout includes the hydraulic crane having a vertical center post located centrally of the trailer and having its elongated hydraulic fluid cylinder mounted longitudinally; the crane hydraulic power unit mounted to the front and laterally of the crane center post; the control panel and the associated operator's seat mounted to the front of the crane hydraulic power unit; and the vibratory driver hydraulic power unit mounted in front of the crane. The trailer includes outriggers at the rear corners adjacent respectively to the oversized tires. The trailer includes a vibratory driver cradle for securely holding the vibratory driver on the trailer during road transportation of the trailer. The cradle is located on the trailer laterally of, and behind, the crane on a side opposite to the operator's seat.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
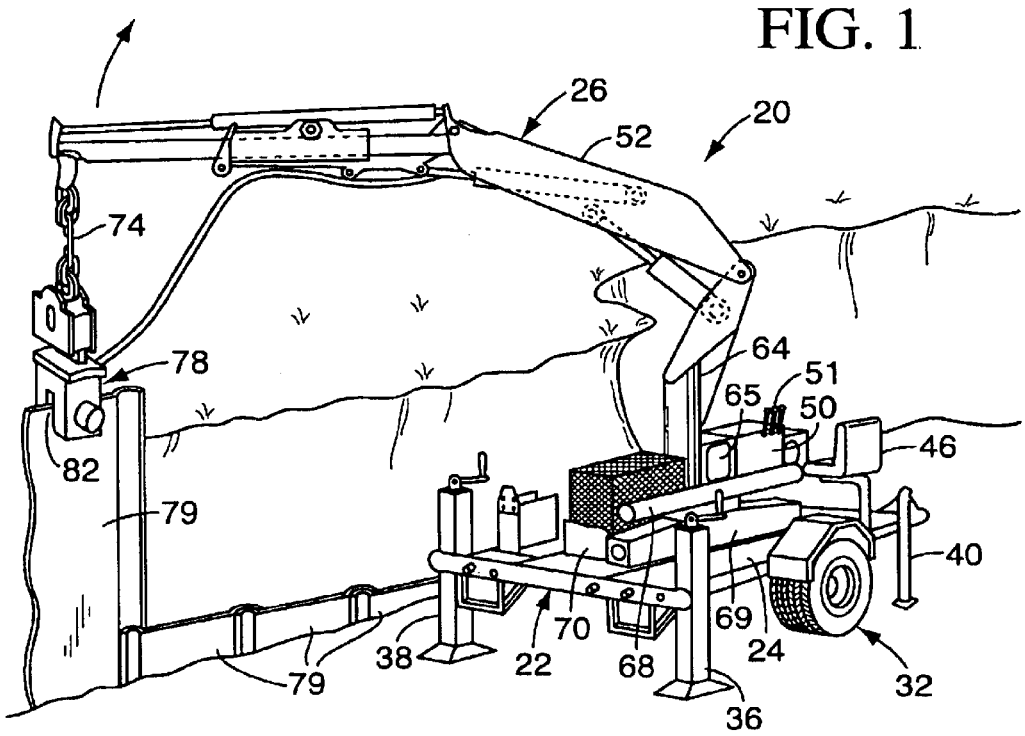
FIG. 1 is a perspective view of a trailer-mounted crane apparatus of the present invention in use in installing a piling sheet.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Figure 2:
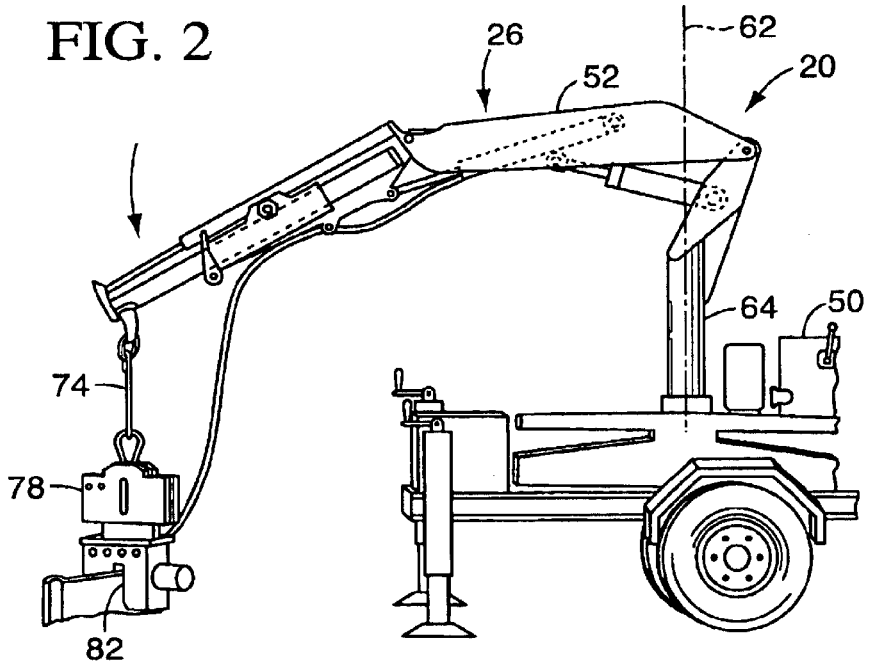
FIG. 2 is a fragmentary perspective view of the trailer-mounted crane apparatus of FIG. 1, in a latter stage of driving a piling sheet.

FIGS. 1 and 2 illustrates a trailer-mounted crane apparatus 20 in accordance with the present invention. The apparatus 20 includes a trailer 22 supporting a crane 26. The trailer 22 includes a platform 24 which surrounds the crane 26. The trailer 22 is supported on wheels 32, 34 (shown in FIG. 3). The trailer 22 can be further supported or stabilized by two or more outriggers 36, 38, 40, 42 (shown in FIG. 3) extending from the platform 24, which can be used to increase the overturning capacity of the crane, or to level the crane as needed. Attached to the platform 24 is an operator's seat 46 which is disposed adjacent to, and laterally of, a control panel 50. The control panel includes control actuators 51.

In a prototype trailer-mounted crane apparatus, a salvaged, solid body trailer (non-tilt) was utilized. The trailer is a standard trailer used in the cable industry for hauling 4000–5000 pound spools of cable and having a capacity of 12,000 pounds.

The crane 26 is of a known configuration such as disclosed in U.S. Pat. No. 4,183,712. It is of a hydraulically operated boom configuration having an arm or boom 52 which can telescopically extend outwardly, pivot upwardly and pivot about a vertical centerline 62 of a central post 64 of the crane 26. The crane arm 52 preferably has a 16 foot reach.

A hydraulic power unit 65 (shown schematically as a box) drives the crane and is in control communication with the panel 50. The power unit typically includes a gasoline or diesel powered engine which drives a hydraulic pump for generating pressurized hydraulic fluid.

The crane center post 64 is welded or otherwise connected to an elongated, cylindrical actuator 68 which is located above, and welded or otherwise connected to, an outrigger cylinder 69, which is mounted and fastened to the trailer 22 as described below. The actuator 68 contains a two-way piston (not shown) which is operatively connected to the center post 64, such as by a rack and pinion arrangement, to cause corresponding rotation of the center post upon linear actuation of the two-way piston. The outrigger cylinder 69 has a substantially rectangular cross-sectional profile. A hydraulic fluid reservoir 70 is fastened or otherwise connected to the outrigger cylinder 69. The center post 64 and reservoir 70 are substantially aligned on a longitudinal centerline 71 of the platform 24, as shown in FIG. 3.

The outrigger cylinder 69 is not used for outrigging in the apparatus 20. In the prototype trailer-mounted crane apparatus, the crane 26 was salvaged from a lifting vehicle which utilized the outrigger cylinder in a laterally extending orientation such that side outriggers could be deployed laterally to either side of the vehicle and then adjusted vertically to contact the ground. Although the outrigger cylinder was not utilized for deploying outriggers in the prototype, the weight of the outrigger cylinder, arranged longitudinally, assists in stabilizing the trailer and resisting overturning forces. Additionally, the salvaged crane 26 with its outrigger cylinder 69 arranged longitudinally, conveniently bolts to the cross bracing of the trailer 2, as described hereinafter.

At a distal end of the crane arm 52, a support chain, cable or line 74 holds a vibratory device 78 which is used for driving piling sheets 79. The vibratory device 78 includes a hydraulically actuated jaw 82 for gripping a top edge of the piling sheet 79. The vibratory device 78 includes an internal vibrational drive motor (not shown) which, combined with the weight of the vibrational device 78 pressed down on the sheet, causes vibration to drive the sheet 79 into the ground as shown in FIG. 2. Such vibratory drivers are known in the industry, such as available from American Pile Driving Equipment Corporation and weighing about 900 lbs.

Figure 3:
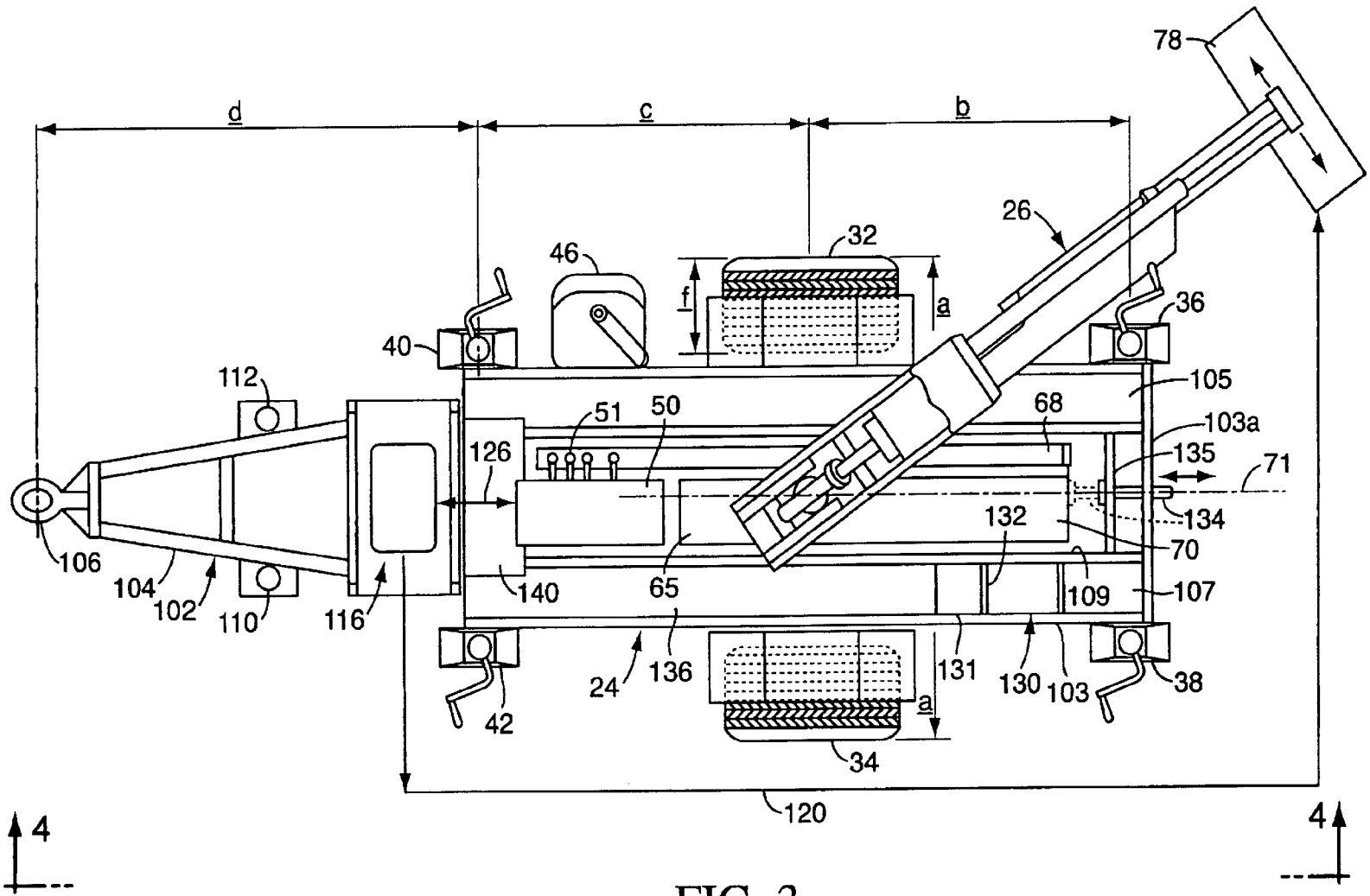
FIG. 3 is an enlarged plan view of the trailer-mounted crane apparatus of FIG. 1.
Figure 4:
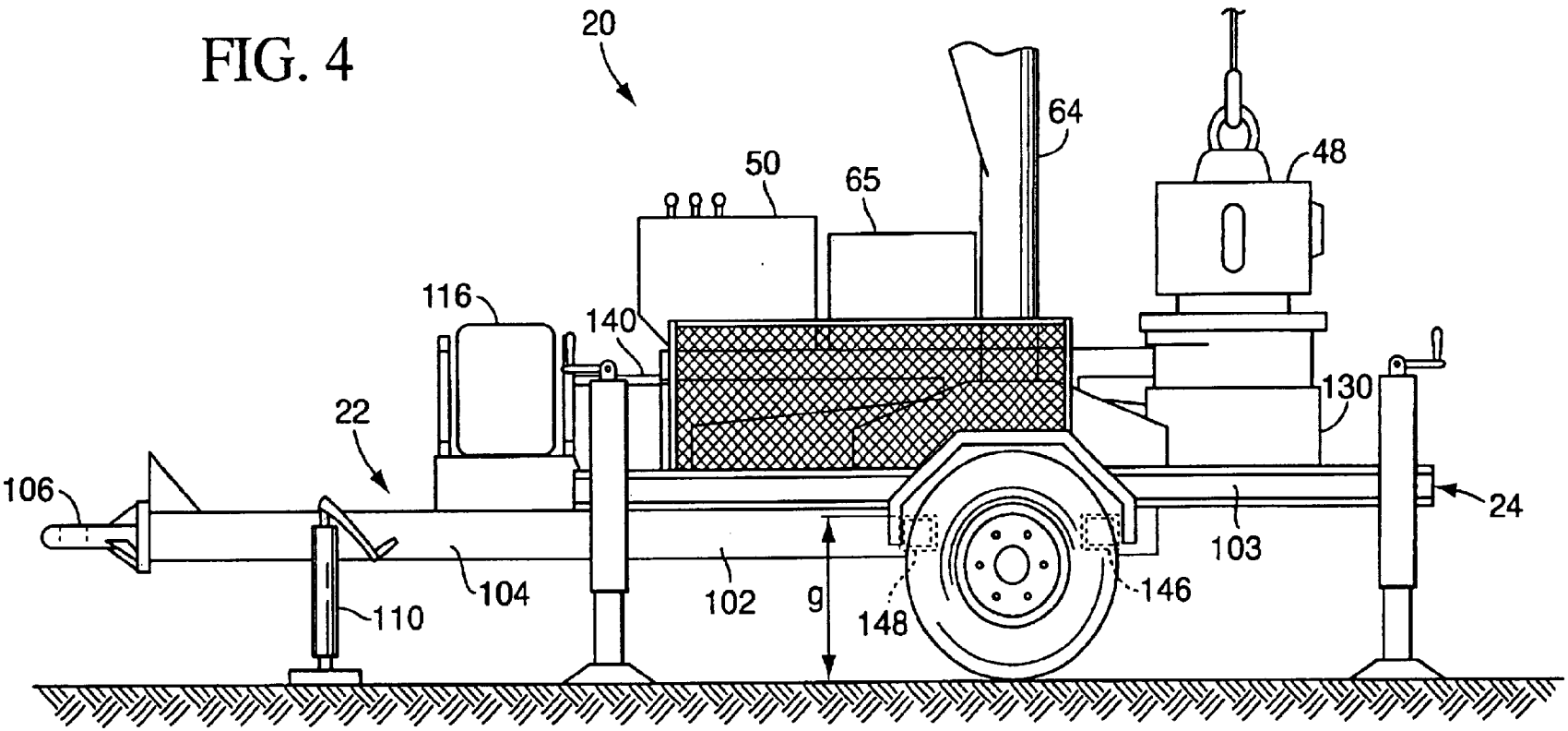
FIG. 4 is an elevational view of the crane apparatus taken along line 44 shown in FIG. 3.

FIGS. 3 and 4 illustrate the layout of the trailer-mounted crane apparatus 20. The platform 24 is supported on an undercarriage 102 (shown in FIG. 5). The platform includes a surrounding rectangular steel frame 103 and two longitudinal spaced apart deck 105, 107, separated by an open central space 109. The crane 26, including the control panel 50, the actuator 68, the outrigger cylinder 69, the center post 64, and the reservoir 70, as an integral unit, is mounted within the central space 109 onto the undercarriage 102. The undercarriage 102 includes an A-shaped frame 104 having a hitch attachment 106 at an apex thereof. Additionally, two lifting jacks 110, 112 are located adjacent the hitch attachment 106 for lifting the frame 104 in order to engage the hitch attachment 106 to a vehicle hitch.

Between the lifting jacks 110, 112 and the platform 24, a vibrational driver hydraulic power unit or power pack 116 (shown schematically as a box) is mounted on the undercarriage and is dedicated to driving the vibrational driver 78. The power unit 116 typically includes a gasoline or diesel powered engine driving a hydraulic pump to produce pressurized hydraulic fluid. Hydraulic lines 120 schematically indicated in FIG. 3 by a single line, and shown in FIG. 8, communicate hydraulic fluid control and power from the power unit 116 to the vibrational driver 78. Hydraulic and/or electrical control lines 126 communicate between the control panel 50 and the power unit 116. Thus, an operator siting in the seat 46 can control both the movement and operation of the crane arm 52 and the operation of the vibrational driver 78.

A vibrational driver cradle 130 is located at a rear of the platform 24 and is used for receiving and fixedly holding the vibrational driven 78 during road transportation of the apparatus 20. The cradle has a surrounding wall 131 and an interior plate 132 for clamping by the jaw 82 of the driver 78. An alternate driver retainer in the form of a rod 134 extends rearwardly from the platform 24 and is supported by a support bar 135 within the space 109, and a rear bar 103*a* of the frame 103. During movement in the field, the vibrational driver can be temporarily held securely onto the rod 134 by the jaw 82. Thus, the more secure, but more time consuming, placement of the driver 78 into the cradle 130 is avoided for short trips in the field. The driver 78 can be quickly and easily clamped to the rod 134 and held thereby. For transportation on the roadway, the driver 78 can be installed into the cradle 130 and the rod 134 can be recessed behind the rear bar 103*a* of the frame 103 as shown in phantom.

Figure 8:
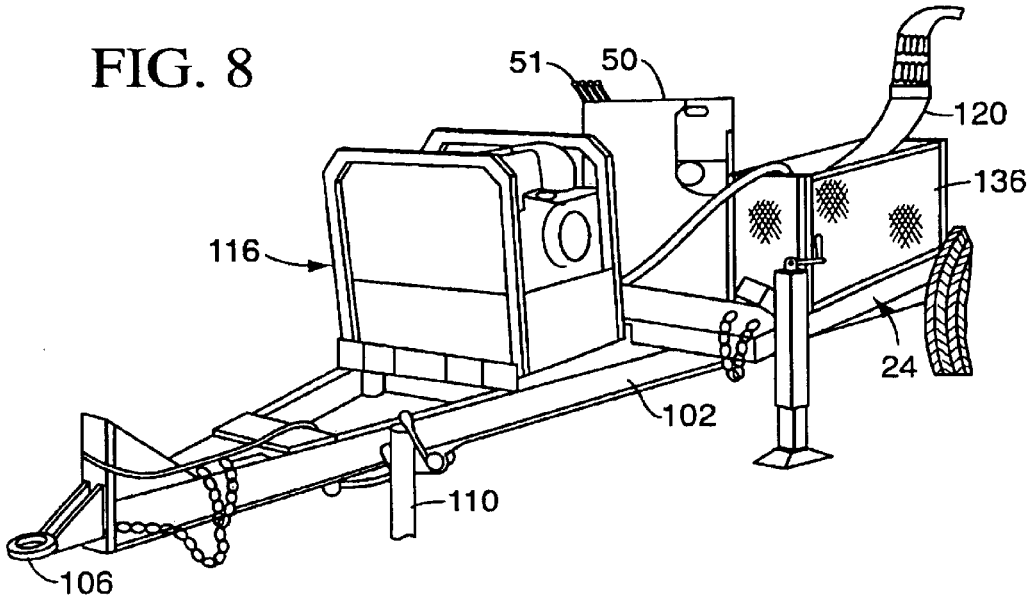
FIG. 8 is an enlarged, fragmentary front perspective view of the trailer-mounted crane apparatus of FIG. 1.

In front of the cradle 130, and laterally of the crane center post 64, is a hydraulic tubing accumulator box 136. Especially when the driver 78 is stored in the cradle 130, the box 136 can hold hydraulic lines otherwise extending between the power unit 116 and the driver 78 as shown in FIG. 8. An onboard tool storage box 140 can be provided in the space between the control panel 50 and the power unit 116.

Figure 5:
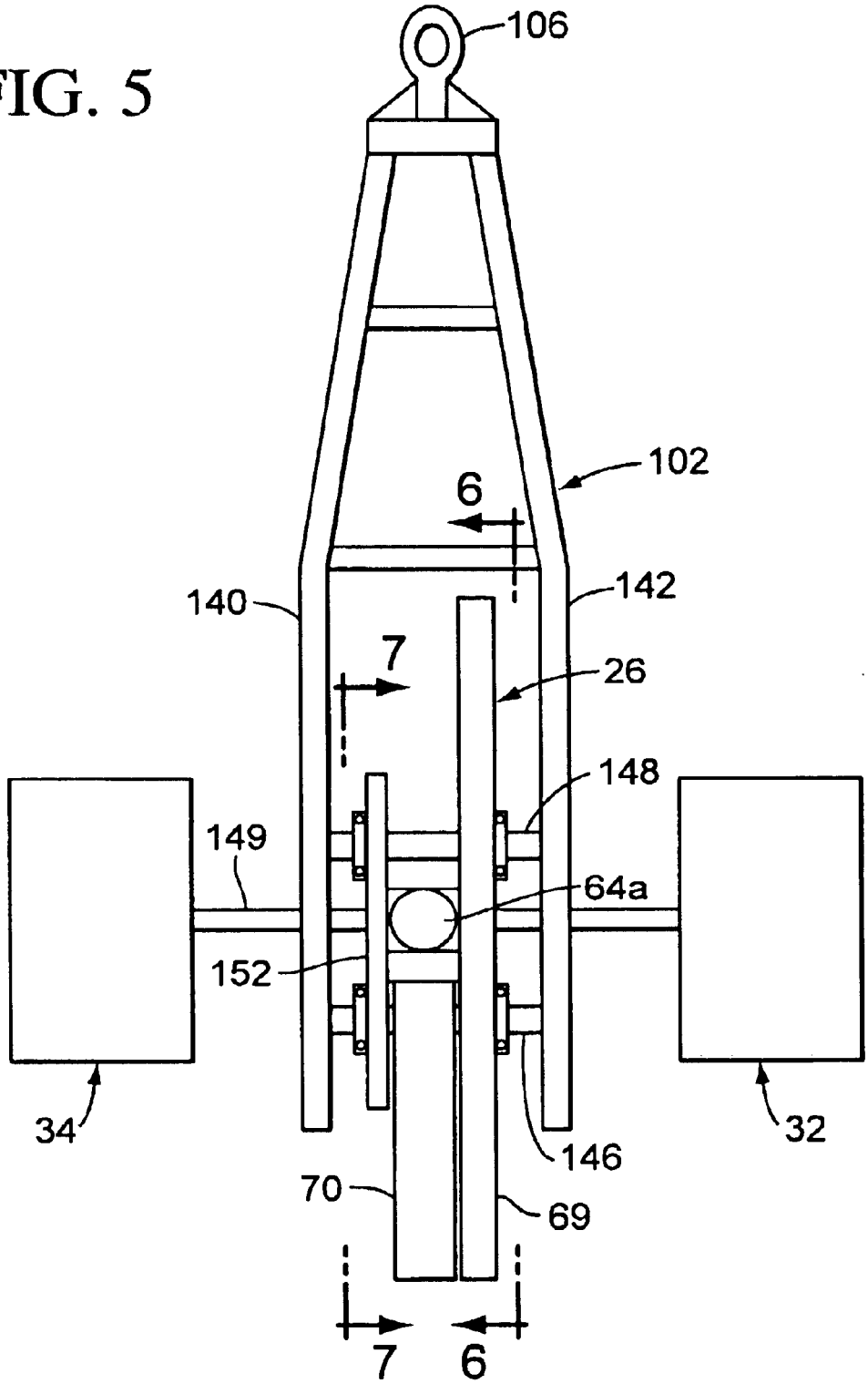
FIG. 5 is a diagrammatical, plan view of an undercarriage of the trailer and the crane supported thereby.

FIG. 5 illustrates the undercarriage 102 and lower crane components supported thereon. The undercarriage comprises longitudinal beams 140, 142 which are laterally spaced apart and connected together by lateral beams 146, 148. The beams 140, 142 support the platform 24 shown in FIGS. 1–4. The beams 140, 142, 146, 148 can be rectangular tubular members. The connection between the beams can be welded connections. The crane components supported include: the outrigger reservoir 69 arranged longitudinally, the fluid reservoir 70, a support bracket 152, and a base 64*a* for the rotatable center post 64 all integrally fastened or welded together as a unit. The crane components described are set onto the lateral beams 146, 148 and fastened thereto.

Figure 6:
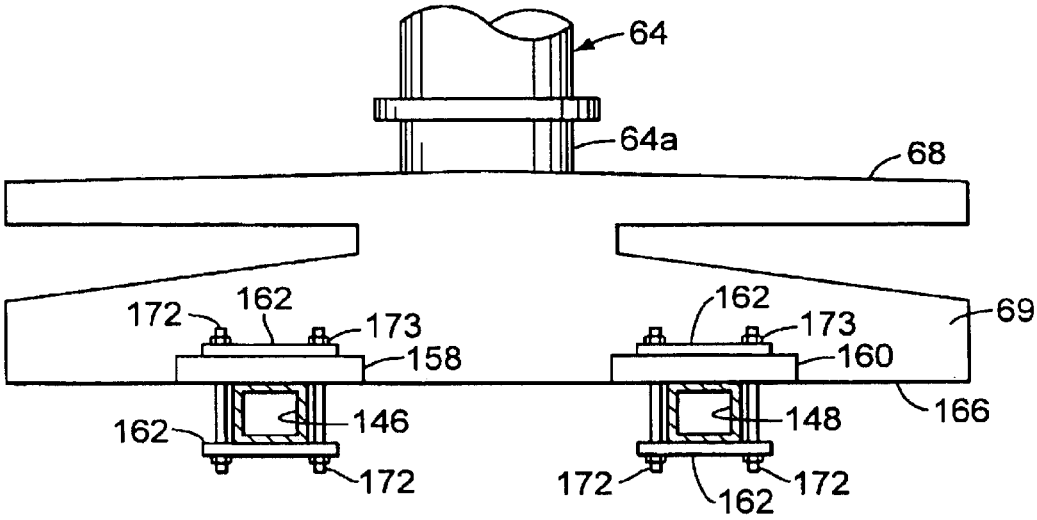
FIG. 6 is a sectional view taken generally along line 6—6 of FIG. 5.

As shown in FIG. 6 the lateral outrigger reservoir 69 includes longitudinally arranged bolt channels 158, 160 having open top and bottom faces. A rectangular washer plate 162 is place against opposite faces of each channel 158, 160, the washer plate 162 having a width wider than the open top and bottom faces of the channels. A bottom surface 166 of the lateral outrigger reservoir 69 is supported on the lateral beams 146, 148. A pair of through bolts 172 and associated nuts 173 clamp the bottom surface 166 to the lateral beam 146, 148 using the two plate washers 162 respectively.

Figure 7:
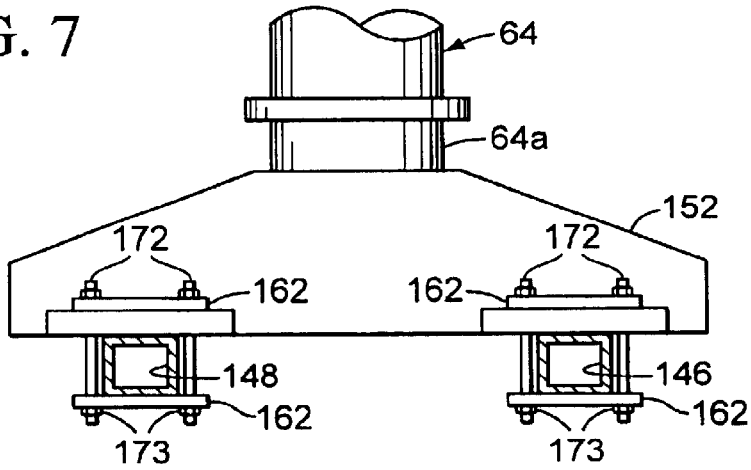
FIG. 7 is a sectional view taken generally along line 7—7 of FIG. 5.

As shown in FIG. 7, the support bracket 152 is mounted to the lateral beams 146, 148 in the same fashion. Thus, the crane 26 is bolted in a four point grid on the undercarriage 102.

The lateral beams 146, 148 are spaced approximately equidistant to, and on opposite sides of, an axle 149 which supports the undercarriage 102 from the wheels 32, 34.

Figure 9:
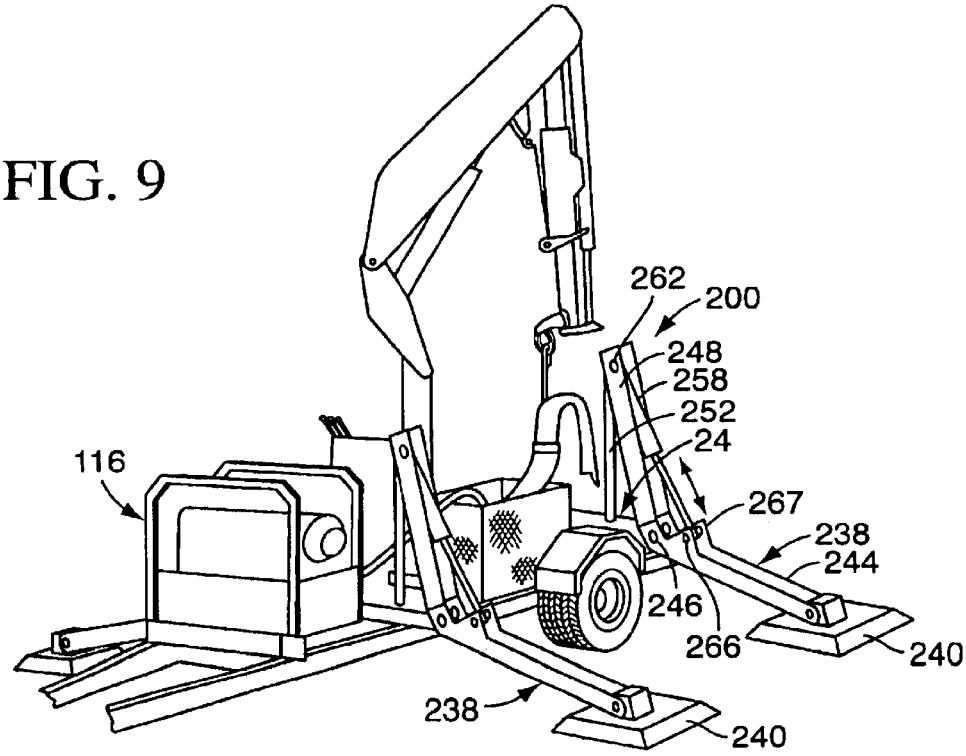
FIG. 9 is a fragmentary perspective view of an alternate embodiment trailer-mounted crane apparatus.

FIG. 9 illustrates an alternate embodiment trailer-mounted crane apparatus 200 which is substantially identical to the apparatus 20 except that the outriggers 36, 38, 40, 42 are replaced with outwardly extending, pivotable outriggers 238 at all four corners which pivot downwardly to press rectangular pads 240 onto the ground. These outriggers 238 allow a wider support, extending out about 5 feet from the platform 24. These outriggers 238 each utilize an arm 244 pivotally connected to the pad 240. The arm is pivotally connected at a point 246 to the platform 24 and to a channel-shaped riser 248. The riser is braced by a column 252 fixedly connected to the platform 24. A hydraulic cylinder 258 is pivotally connected at a connection 262 to the riser 248 and at a connection 266 to lugs 267 welded to the arm 244. Thus, expansion or contraction of the hydraulic cylinder 258 will cause pivotal lowering or raising of the arm. The arm 244 can be raised to a substantial vertical position for road travel. The outriggers 238 can be controlled from the control panel 50.

It is also encompassed by the invention that outriggers 238 are only provided at the rear corners, which has been demonstrated to work satisfactorily. It is also encompassed by the invention to provide the vertically movable outriggers 36, 38, 40, 42 along with the outriggers 238, at the rear corners only or at all four corners. Depending on the surface encountered, the outriggers 36, 38, 40, 42 and/or the outriggers 238 can then be deployed.

The major components for the crane apparatus 20, 200 are commercially available. For example, the crane 26 can be a HIAB-FOGO (Sweden) model 650 (year 1971) or similar. The vibratory driver 78 and the driver hydraulic power unit 116 can be a Model 6 vibratory hammer and Model 14 power pack from American Piledriving Equipment, Inc. of Kent, Washington. The trailer platform 24 can be a Vermeer single axle (6 foot by 9 foot platform) trailer having a 16' overall length, such as salvaged from a trailer used to transport large electrical coils.

The preferred dimensions for the apparatus 20 are as follows (referring to FIGS. 3 and 4). The wheel base dimension a is about 108 inches. The longitudinal dimension b between the rear outriggers 36, 38 and the wheel centerline is about 55 inches. The longitudinal distance c between the wheel centerline and the front outriggers 40, 42 is about 53 inches. The longitudinal distance d between the front outriggers 40, 42 and the hitch 106 is about 7 feet. The wheels 32, 34 use tires 32*a*, 34*a* which are oversized and are particularly useful in travel throughout a golf course where damage to delicate or pristine areas of the course must be avoided. For example, the tires 32*a*, 34*a* will not damage the surface of a putting green. The width of the tires of the preferred embodiment are effective to dissipate the trailer load over a wide ground surface area. The tires are nearly twice the width of the street tires (using 8.75 inch rims for road use) which are used to transport the trailer on roadways. In this regard, the tires have a tread width f of 16 inches. The ground height g to the support point of the crane 26 is about 19½ inches.

The prototype crane apparatus 20 has a total weight of approximately: 5600 pounds. The crane assembly, including the components 26, 50, 65, weighs about 2700 pounds. The vibratory driver 78 weighs about 900 pounds. The vibratory driver power unit 116 weighs about 700 pounds. The trailer weighs about 600 pounds. The outriggers shown in FIG. 9 (rear only) together weigh about 650 pounds.

The present invention provides a compact, lightweight yet effective trailer-mounted crane apparatus especially suited for soft or delicate terrains. The compact trailer-mounted crane apparatus has a lifting capacity of at least 1200 pounds at a reach of 16 feet which is well suited for driving sheet piling using a 900 pound vibratory driver.

The present invention is particularly useful in driving sheet piling on golf courses. Using a vibratory driver, sheets can be driven at night without generating an excessive amount of noise.

The present invention apparatus 20, 200 effectively combines a lifting apparatus with a vibratory driver device into a single, compact and effective piece of equipment. A single operator seated on the trailer can control both the crane and the vibratory driver. Heretofore, the vibratory driver was lifted by an operating piece of equipment such as a back hoe, and the vibratory drive was controlled by a second operator with the vibratory hydraulic power unit located separate from the back hoe. This unnecessarily used staging area which could be better suited in storing materials or staging other equipment participating in the sheet piling installation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A mobile crane apparatus, comprising:

a trailer having a frame supported for road travel on only a single axle that mounts a wheel on each opposite end of said axle, said trailer having a substantially rectangular trailer platform carried on said frame;

a hydraulically operated crane having a center post and a boom, said center post supported at a fixed position on said trailer to extend upwardly from a central location of said trailer platform, said central location substantially centrally located both longitudinally and laterally of said trailer platform, and said boom being telescopically extendable outwardly from said center post, said boom extendable to a reach of at least about 16 feet, said trailer and said crane configured to have a weight of about 5000 pounds and a lifting capacity of at least about 1200 pounds at a reach of about 16 feet;

said center post rotatable about a vertical axis to position said boom, said center post located between said wheels centered on a longitudinal position that is between a longitudinal front edge of said wheels and a longitudinal rear edge of said wheels;

an attachment located at a free end of said boom for connecting a lifting line; and a crane operator control station carried by said trailer, said control station fixed in position on said trailer independent of said center post such that rotation of said center post does not move said operator control station, said operator control station facing a lateral side of said trailer.

2. The crane apparatus according to claim 1, further comprising a vibratory driver suspended from said free end of said crane via said attachment and arranged and configured to grasp and then drive a piling sheet into the ground.

3. The crane apparatus according to claim 1 wherein said wheels comprise tires having a width of about 16 inches.

4. The crane apparatus according to claim 1, comprising a crane hydraulic power unit and an accessory hydraulic power unit carried by said trailer.

5. The crane apparatus according to claim 1, further comprising a sheet piling driver suspended from said crane.

6. The crane apparatus according to claim 1, wherein said crane operator control station comprises a control panel having said controls for operating said crane, and a seat mounted to said trailer for supporting an operator at said control panel.

7. The crane apparatus according to claim 1, comprising a hydraulic power unit having said controls, and a seat supported on said trailer and located for an operator to manually control said controls.

8. The crane apparatus according to claim 6, wherein said seat is arranged facing in a direction perpendicular to a longitudinal axis of said trailer.

9. The crane apparatus according to claim 1, comprising outriggers arranged at respective back corners of said trailer and deployable to support the back corners of said trailer from the ground.

10. The crane apparatus according to claim 9, wherein said outriggers are hydraulically deployable.

11. A trailer-mounted crane apparatus, comprising:

a compact trailer having a frame supported from a ground surface on at least two wheels having a common axis of rotation, said trailer having a substantially rectangular trailer platform carried by said frame;

a hydraulically operated crane arm and a post, said post mounted to said trailer at a fixed position to extend upwardly from a central location of said trailer platform, said central location substantially centrally located both longitudinally and laterally of said trailer platform, said post mounted to said trailer centered on a longitudinal position that is between a longitudinal front edge of said wheels and a longitudinal rear edge of said wheels, said crane arm mounted to, and extendable from, said post;

a hydraulic crane power unit mounted to said trailer for supplying pressurized hydraulic fluid to said crane arm;

a control panel carrying controls for said hydraulic power unit, said control panel mounted on said trailer independent of movement of said post, an operator seat supported from said trailer independent of movement of said post and arranged to face said control panel:

a vibratory sheet pile driver suspended from said crane arm;

a hydraulic driver power unit for driving said vibratory sheet pile driver mounted on said trailer, wherein said control panel includes controls for said hydraulic driver power unit, an operator on said seat capable of reaching said controls for said hydraulic crane power unit and for said hydraulic driver power unit;

a longitudinally extended hydraulic cylinder mounted longitudinally along said trailer, said hydraulic cylinder operatively connected to said post to rotate said post;

wherein said hydraulic crane power unit is mounted on said trailer in front of said post, and said control panel and said operator seat are mounted in front of said hydraulic crane power unit and laterally of said post, and said hydraulic crane power unit is mounted in front of said post; and a sheet pile driver retainer extending rearwardly of said trailer, and mounted to said trailer.

12. A trailer-mounted crane apparatus, comprising:

a compact trailer having a frame supported from a around surface on at least two wheels having a common axis of rotation, said trailer having a substantially rectangular trailer platform carried by said frame;

a hydraulically operated crane arm and a post, said post mounted to said trailer at a fixed position to extend upwardly from a central location of said trailer platform, said central location substantially centrally located both longitudinally and laterally of said trailer platform, said post mounted to said trailer centered on a longitudinal position that is between a longitudinal front edge of said wheels and a longitudinal rear edge of said wheels, said crane arm mounted to, and extendable from, said post;

a hydraulic crane power unit mounted to said trailer for supplying pressurized hydraulic fluid to said crane arm;

a control panel carrying controls for said hydraulic power unit, said control panel mounted on said trailer independent of movement of said post, an operator seat supported from said trailer independent of movement of said post and arranged to face said control panel;

a vibratory sheet pile driver suspended from said crane arm;

a hydraulic driver power unit for driving said vibratory sheet pile driver mounted on said trailer, wherein said control panel includes controls for said hydraulic driver power unit, an operator on said seat capable of reaching said controls for said hydraulic crane power unit and for said hydraulic driver power unit;

a longitudinally extended hydraulic cylinder mounted longitudinally along said trailer, said hydraulic cylinder operatively connected to said post to rotate said post;

wherein said hydraulic crane power unit is mounted on said trailer in front of said post, and said control panel and said operator seat are mounted in front of said hydraulic crane power unit and laterally of said post, and said hydraulic crane power unit is mounted in front of said post; and a sheet pile driver cradle mounted to said trailer on a side of said post opposite to said operator's seat.

* * * * *

UNITED STATES PATENT AND TRADEMARK OFFICE

CERTIFICATE OF CORRECTION

PATENT NO. : 6,966,448 B1
APPLICATION NO. : 09/644923
DATED : November 22, 2005
INVENTOR(S) : Darryl Scott Burkett It is certified that error appears in the above-identified patent and that said Letters Patent is hereby corrected as shown below:

At column 2, line 56, change “44” to --4 - 4--.
At column 8, line 24, change “around” to --ground--.

Signed and Sealed this

Third Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 6,966,448 B1
APPLICATION NO. : 09/644923
DATED : November 22, 2005
INVENTOR(S) : Darryl Scott Burkett It is certified that error appears in the above-identified patent and that said Letters Patent is hereby corrected as shown below:

At column 2, line 56, change “44” to --4 - 4--.
At column 8, line 24, change “around” to --ground--.

Signed and Sealed this

Thirty-first Day of October, 2006

JON W. DUDAS
*Director of the United States Patent and Trademark Office*